US011024219B2

(12) United States Patent
Fontecchio et al.

(10) Patent No.: US 11,024,219 B2
(45) Date of Patent: Jun. 1, 2021

(54) DIRECT INTEGRATION OF INDIVIDUALLY CONTROLLED PIXELS INTO A KNITTED FABRIC MATRIX

(71) Applicant: Drexel University, Philadelphia, PA (US)

(72) Inventors: Adam K Fontecchio, Downingtown, PA (US); Alyssa Ann Bellingham, Philadelphia, PA (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 15/753,384

(22) PCT Filed: Aug. 22, 2016

(86) PCT No.: PCT/US2016/047940

§ 371 (c)(1),
(2) Date: Feb. 19, 2018

(87) PCT Pub. No.: WO2017/031484

PCT Pub. Date: Feb. 23, 2017

(65) Prior Publication Data

US 2018/0240396 A1 Aug. 23, 2018

Related U.S. Application Data

(60) Provisional application No. 62/207,811, filed on Aug. 20, 2015.

(51) Int. Cl.
*G09G 3/30* (2006.01)
*G09F 9/305* (2006.01)
(Continued)

(52) U.S. Cl.
CPC ..... *G09G 3/30* (2013.01); *D04B 1/14* (2013.01); *D04B 21/14* (2013.01); *G09F 9/30* (2013.01);
(Continued)

(58) Field of Classification Search
CPC ..... G09G 3/30; G09G 3/2003; D04B 1/14; D04B 21/14
See application file for complete search history.

(56) References Cited

U.S. PATENT DOCUMENTS 6,229,259 B1 * 5/2001 Christensen, Sr. ..... H01L 27/32 257/40
7,144,830 B2 * 12/2006 Hill ..... H05K 1/038 442/205
(Continued)

FOREIGN PATENT DOCUMENTS

CN 2501278 7/2002

OTHER PUBLICATIONS

PCT/US16/47940, Nov. 7, 2016 Search Report and Written Opinion.

*Primary Examiner* — Kenneth B Lee, Jr.
(74) *Attorney, Agent, or Firm* — Schott, P.C.

(57) ABSTRACT

A flexible and scalable emissive fabric display with individually controllable pixels disposed within a fabric matrix. The pixels may include areas where electroluminescent thread contact conductive threads, and take the form of either individual stitches, or contact points between perpendicularly inlayed conductive threads and electroluminescent threads. Alternatively, the pixels may include individual electroluminescent segments disposed along a conductive thread.

19 Claims, 3 Drawing Sheets

(51) Int. Cl.

| | |
|---|---|
| ***D04B 1/14*** | (2006.01) |
| ***G09G 3/12*** | (2006.01) |
| ***G09F 9/30*** | (2006.01) |
| ***D04B 21/14*** | (2006.01) |
| ***G09G 3/20*** | (2006.01) |
| *A41D 1/00* | (2018.01) |

(52) U.S. Cl.
CPC ..... *G09F 9/305* (2013.01); *G09G 3/12* (2013.01); *G09G 3/2003* (2013.01); *A41D 1/002* (2013.01); *D10B 2401/16* (2013.01); *D10B 2401/20* (2013.01); *G09G 2330/02* (2013.01); *G09G 2380/02* (2013.01)

(56) References Cited

U.S. PATENT DOCUMENTS

| | | | | |
|---|---|---|---|---|
| 2007/0156276 | A1* | 7/2007 | Smedley | D04B 37/02 700/141 |
| 2010/0123385 | A1* | 5/2010 | Perera | C09K 11/025 313/502 |
| 2016/0165970 | A1* | 6/2016 | Jost | H01G 11/24 219/211 |

* cited by examiner

DIRECT INTEGRATION OF INDIVIDUALLY CONTROLLED PIXELS INTO A KNITTED FABRIC MATRIX

BACKGROUND

Smart textiles are revolutionizing the textile industry by combining technology into fabric to give clothing new abilities including communication, transformation, and energy conduction. The advent of electroluminescent fibers, which emit light in response to an applied electric field, has opened the door for fabric-integrated emissive displays in textiles. Dynamic emissive textile displays have the potential to introduce new functionality into fabrics and clothing, such as the ability gather and display information for medical research, biomedical monitoring, military surveillance and protection, safety gear, entertainment, and fashion.

Typically, displays are fabricated onto flexible substrate and then mounted onto textiles, but there have been reports of textiles incorporating discrete components (e.g. sensors, batteries, LEDs) with laminated or knit conducting interconnects and also electro-optically integrated devices. However, the displays produced from these technologies are bulky, uncomfortable, expensive to implement, and don't retain the full visibility of the underlying garment. These factors present a barrier to their widespread use in the textile industry.

Emissive components in textiles were seen as early as 1967, when young fashion designer Diana Dew sewed what Time magazine called "pliable plastic lamps" into clothing. Around the same time, NASA space suits were supporting lights mounted to helmets so astronauts could perform orbital operations in the dark. However, these devices did not have the ability to change dynamically to display information. Until recently, most reports of dynamic displays in textiles have been non-emissive and are for mostly for aesthetic purposes. But over the past few decades, emissive dynamic textile displays have been emerging in literature and in real life.

Current routes to incorporating displays into garments include laminating prefabricated devices onto clothing, incorporating discrete components (e.g. sensors, batteries, controller chips) with laminated or knit conducting interconnects and using electro-optically integrated structures. However, these methods often produce textiles displays that are bulky, uncomfortable, expensive to implement, and don't retain the full flexibility of the underlying textile, which are barriers to their widespread use in the textile industry. To combat these issues, many researchers have focused on creating electroluminescent fibers that can be directly integrated into a textile.

Recent progress in fabricating electroluminescent fiber shaped devices that can be directly integrated into knitted and woven structure has unlocked new opportunities for creating fabric-integrated displays. Most of this research has focused on the development of robust fiber devices capable of achieving equivalent brightness, efficiency, and lifetime as planar electroluminescent devices rather than implementation into textiles. While several groups have demonstrated light emitting fabrics composed of such fibers, most of these displays are not capable of dynamically displaying information, which is a highly desired component for many applications. As such, there is a distinct need for a fabric display which retains the full flexibility of the underlying textile, is capable of dynamically displaying information, can be produced cheaply and scalably, and is compact and comfortable.

SUMMARY OF THE EMBODIMENTS

A flexible and scalable emissive fabric display with individually controllable pixels disposed within a fabric matrix. The pixels may include areas where electroluminescent thread contact conductive threads, and take the form of either individual stitches, or contact points between perpendicularly inlayed conductive threads and electroluminescent threads. Alternatively, the pixels may include individual electroluminescent segments disposed along a conductive thread.

DETAILED DESCRIPTION OF THE EMBODIMENTS

Fabric Matrix

Figure 1:
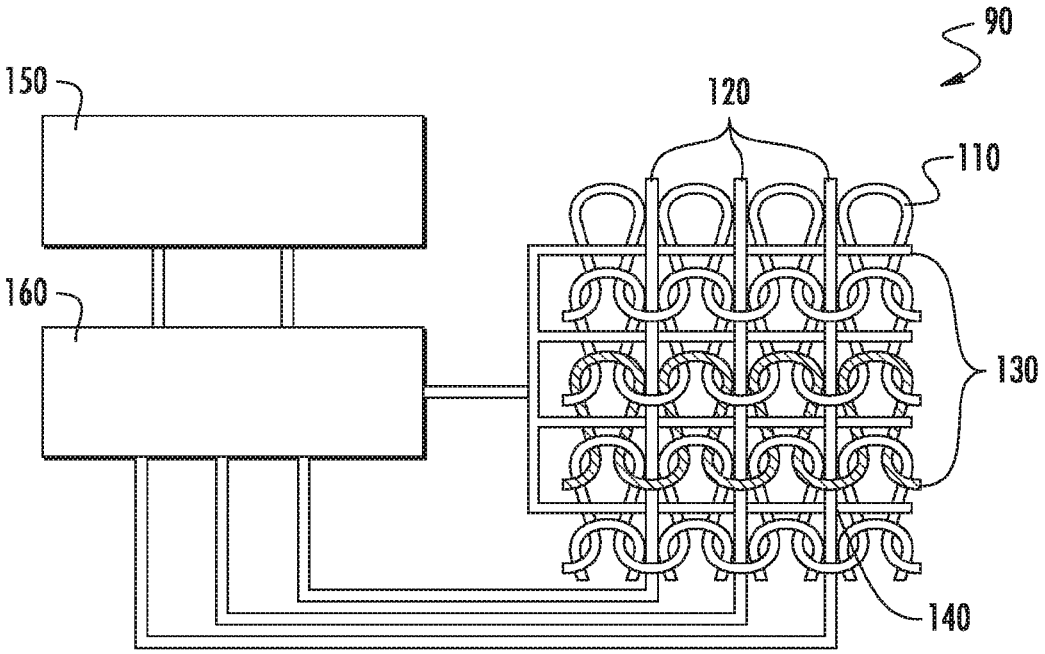
FIG. 1 shows an embodiment of the fabric matrix incorporating a pixel structure.

Knitting provides a platform for supporting fabric-integrated displays as it enables customization in the design and fabrication of wearable smart textiles, offers huge savings in terms of manufacturing costs, and significantly reduces material waste. Knitted fabrics, unlike woven fabrics, have the ability to be produced from a single continuous thread but additional threads may be added into the knit for reinforcement, fashion, or to introduce functionality into the fabric. The biaxial knitted structure display 90, as shown in FIG. 1, incorporates layers of warp 120 and weft 130 threads held together by a stitch thread system 110. It is typically used for fabric reinforcement, but additional intersecting threads inside the knitted matrix may be used to support a display structure. Additionally, continuous lengths of EL fiber may also be incorporated into the biaxial knit structure display 90 by mass production methods, making it possible to scale production of these displays for general use in the textile industry, resulting in fabric displays that are cheap and easy to mass-manufacture.

First Pixel Structure

Figure 2:
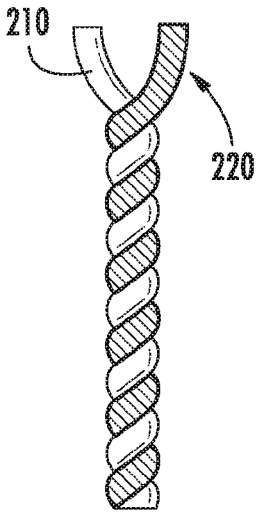
FIG. 2 shows the system comprising a fabric display using a pixel structure.
Figure 3:
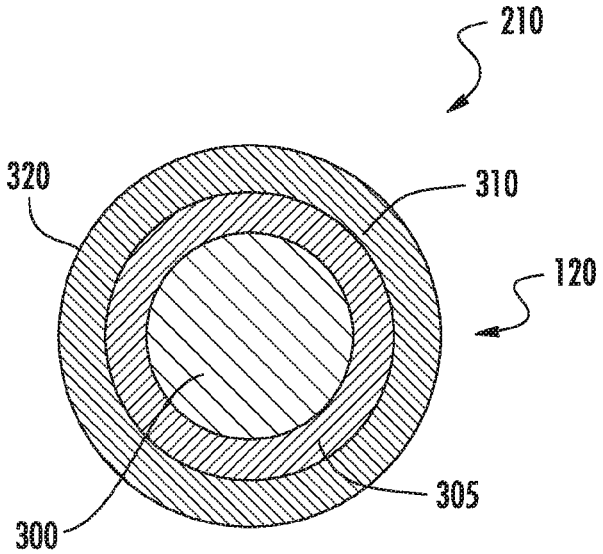
FIG. 3 shows the composition of the electroluminescent thread used in the pixel structure.

In one embodiment of the proposed display, a single pixel comprises, as shown in FIG. 2, a length of conductive thread 210 that is wound or otherwise placed into contact with a length of electroluminescent thread 220. In order to produce a field in the electroluminescent material there needs to be two electrodes: an anode and a cathode, where the anode is supplied with power and the cathode is grounded. Here, the electroluminescent thread 220 forms the cathode, and the conductive thread 210 forms the anode, grounding the cathode and supplying power. When the anode, conductive thread 210, contacts the cathode, electroluminescent thread 220, a field is produced in the electroluminescent material which results in the emission of light at the points of contact. The electroluminescent thread 220 is comprised of multiple layers applied to a conductive and flexible thread substrate 300, and is illustrated in FIG. 3: the first layer is a dielectric layer 305 that is applied directly over the conductive thread substrate 300. Over that is applied an electroluminescent or phosphor layer 310. A protective layer 320 protects the entire structure from damage.

Figure 4:
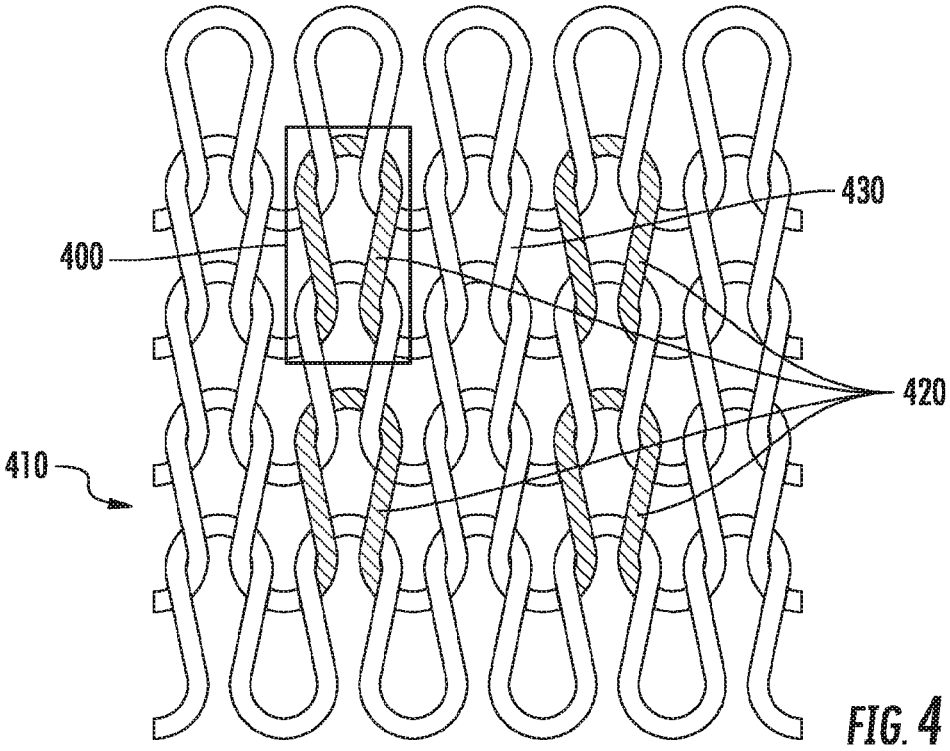
FIG. 4-5 shows the electrode configuration used in the pixel structure.
Figure 5:
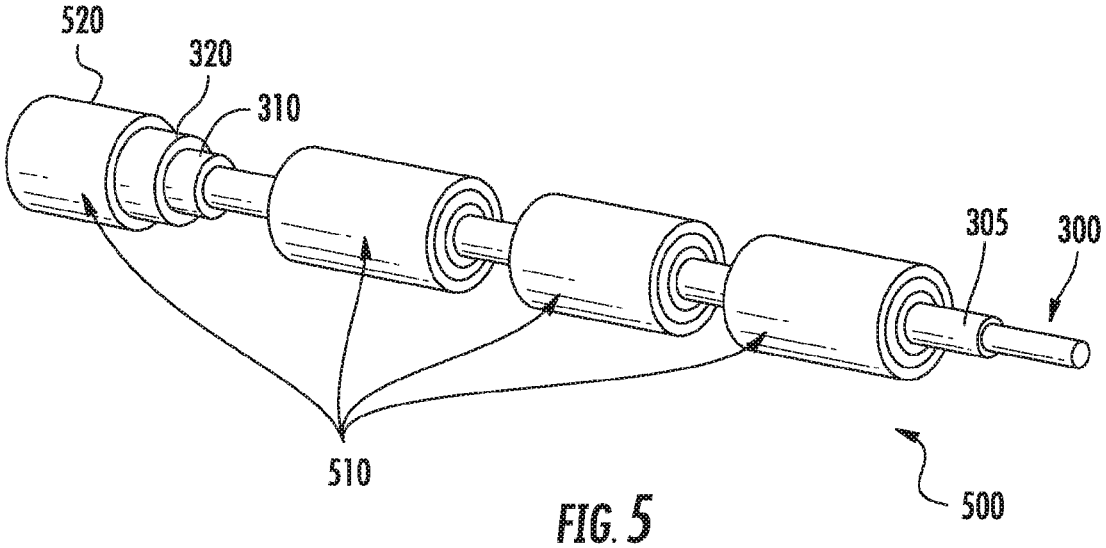

The threads may be incorporated into a knitted fabric display in many ways, two of which may be discussed here. FIG. 4 shows a knit structure 410, into which is incorporated lengths of conductive thread 420. Each pixel 400 is considered to be a single stitch in the knitted structure, and its size is dependent on the weight (or size) of the thread 420, the gauge (tightness of the stitch) and the way by which the pixels are isolated. Pixels 400 can be isolated by such means as using an insulating thread stitch 430 between each pixel, or by using isolating coatings on the threads so that the pixels can be in adjacent stitches without electrically interfering with one another.

The second way is shown in FIG. 1, which illustrates how a biaxial knit allows electroluminescent thread 120 and conductive thread 130 to be inlayed perpendicular to each other into a knitted structure 90 during the production process, with the electroluminescent thread 120 forming the warp and the conductive thread 130 forming the weft. The electroluminescent thread 120 may lack an electrode layer so that light emission will only occur in light emission areas or pixels 140 that are directly in contact with the conductive thread 130. It is only in these light emission areas 140 that the applied field will be high enough to produce electroluminescence, which allows these light emitting areas 140 to act as isolated pixels and be controlled individually. Power is applied from power supply 150 to the ends of the warp and weft fibers running through the knitted structure 90. While all the conductive fibers 130 are grounded, a simple microcontroller-based control system 160 is used to apply power to each electroluminescent fiber 120 individually. Such a control system enables a truly dynamic display.

Second Pixel Structure

A second embodiment of the pixel structure is illustrated in FIG. 8, wherein an electroluminescent structure is fabricated in segments along a segmented conductive fiber 500, where each segment represents a pixel 510. A conductive fiber 300, in some ways like that shown in FIG. 3, is sheathed in a dielectric coating 305 in order to prevent electrical contact with other sections of the thread, prevents shorting and allow multiple pixels to light up independently. This conductive fiber 300 is grounded and supplies power, acting as an anode. Each segment comprises a series of layers; over the dielectric coating 305 is disposed a phosphor coating 310. A protective isolation coating 320 is disposed over the electroluminescent coating. Unlike the thread in FIG. 3, over the protective isolation coating 320 and on the exterior of each pixel 510 is a translucent conductive coating 520, which acts as a cathode when grounded and supplied power by the anode, conductive fiber 300.

The distance between the pixels 510 may be calculated based on the gauge of the knitted material. The conductive thread supporting substrate 300 is grounded and power is applied to the translucent conducting coating 520 to turn each pixel 510 on independently. The electroluminescent thread of this pixel structure may be incorporated into the fabric matrix as a stitch or into the warp and weft of a biaxial knitted structure. The advantages of this second pixel structure are denser pixels than the first pixel structure, and therefore the potential for much higher resolution.

Multicolor Display

Both the first and second pixel structures can be made to create a multicolor display by creating pixels using electroluminescent thread that emits multiple colors. An RGB display can be created by alternating red, green and blue pixels, such that every third pixel is the same color; additionally, an RGB display can be made by making three separate electroluminescent threads with optically transparent isolation coatings, one that emits red light, another green, and the third blue, and twisting the fibers together into a three-strand yarn.

Electroluminescent Device Structure

A display may include a number of different electroluminescent device structures, including organic electroluminescent device structures such as organic light-emitting diodes or light-emitting electrochemical cells, or inorganic electroluminescent device structures such as phosphors.

Organic electroluminescent materials are typically semiconductor materials with a bandwidth wide enough to allow light to exit. Organic materials, especially the polymer-based materials, may be used for electroluminescent thread applications due to their low cost, full-scale color capability and low voltage operation. Organic light emitting diode (OLEDs) and light-emitting electrochemical cells (LECs), are two device structures that may employ organic EL compounds as a light emissive layer. These structures have slightly different modes of operation.

OLEDs can be fabricated from small molecule or polymer materials that emit light upon activation. The simplest OLED devices are composed of a single layer of active material between two electrodes. Electrons are injected from the cathode into the lowest unoccupied molecular orbital (LUMO) of the active layer, while holes are injected from the anode to the highest unoccupied molecular orbital (HOMO) of the emitting layer. Recombination of hole and electrons in the active layer produces light. The anode needs to be transparent enough to allow this light to pass through and has a high work function. Indium tin oxide (ITO) is traditionally used as this front electrode because of its high transparency and conductivity, however the rising cost of indium had led to the exploration of other materials. The work function of the cathode is low to enable efficient electron injection into the active layer. It is possible to increase the efficiency, output and lifetime of these devices by adding charge injection layers between the emitting layer and electrodes. The role of these additional layers can vary based on the materials used. Some can help reduce the difference in energy between the HOMO and LUMO of the emitting layer and fermi energies of the anode and cathode, respectively. This more gradual electronic profile facilitates increase charge injection from one or both electrodes depending upon the materials involved. These layers are called electron transport layers (ETL) and hole transport layers (HTL) as they help facilitate charge injection. Other layers can be used to block charges from reaching the opposite electrode and being wasted. These layers are called electron or hole blocking layers depending upon which type of charge carrier they are meant to prevent from passing.

The addition of mobile ions to the emitting layer of an OLED gives rise to the light-emitting electrochemical cell (LEC). The LEC emitting layer is composed of a conjugated luminescent polymer and solid electrolyte. The emissive polymer in LECs undergoes oxidation and reduction in the presence of salts, which creates intermediate energy states between the HOMO and LUMO. This enhances conductivity and reduces the charge injection barriers. However, processing and fabrication of these materials onto fiber supporting substrates is challenging due to the geometry and uneven surface morphology of fibers, as well as heating effects in the fiber.

Inorganic materials emit light by high field electroluminescence and therefore most of these devices, most notably those comprised of phosphors, only function under AC conditions. When a constant field is applied to these phosphors, there is only temporary light emission which rapidly decays. There is a similar burst of light when the voltage is removed, which is why an alternating voltage is needed to produce continuous electroluminescence. DC effects can contribute to the electroluminescence of these devices depending upon the properties of the dielectric insulting layer. Most of the time, it is desirable to dampen these effects to concentrate the field on the phosphor particles to increase light output. A few groups have fabricated inorganic EL devices that run purely under DC conditions by mimicking a p-n junction structure using inorganic EL material layers or dopants.

This, however, increases the complexity of the fabrication process and would be difficult to mimic on a fiber. There is typically a dielectric layer between one or both electrodes which acts to eliminate DC effects and also protects the inorganic material from heating effects in the electrodes caused by the high applied current. These dielectric materials may have properties such as the dielectric breakdown, for evaluating its insulation ability, and dielectric constant, which is the ratio of the dielectric materials permittivity to that in a vacuum. The dielectric constant determines how much the field strength is decreased inside it, with a higher dielectric constant providing better insulation and maximizing the potential across the phosphor particles in the emitting layer to increase luminance. Although not all inorganic EL materials are phosphors, these are the most widely studied materials used to produce ACEL devices.

The most common phosphors used in EL devices are derived from zinc sulfide (ZnS) and contain small amounts of inorganic dopants that are referred to as activators or luminescent centers. These luminescent centers determine the emission wavelength of the system. Phosphors are dispersed in a host material, which responsible for determining the electrical and electro-optical properties of the system. This host material can be solid, like plastic, ceramic, polymer, or can be a liquid insulator like castor oil. Additionally, it can act as a dielectric binder, eliminating the need for separate dielectric layers and enabling the creation of a single layer ACEL device. A single combined emissive/dielectric layer has a few advantages over the traditional structure including, simple fabrication, increased flexibility of the devices, and cheaper production. This single layer structure is especially attractive for fiber devices which require that the emissive coating be flexible. Due to the high field required to excite the phosphor particles, inorganic phosphor based fibers are not safe for wearables. However, they are promising for other applications like automotive interior lighting because they are simple to deposit, exhibit high luminance and lifetimes, and can be coated onto uneven substrates.

Electroluminescent Structure Deposition

Fabrication techniques and processing conditions play a role in the performance of electroluminescent fibers. Current approaches for fabricating electroluminescent device structures on fiber and thread substrates include evaporation, dip-coating, and extrusion techniques.

In vacuum thermal evaporation, a substrate is mounted in an evaporation chamber above the source material which is bombarded by a high energy source (such as electrons or heat) to vaporize the material. The chamber is placed under vacuum, which guides vapor particles from the evaporated source material towards the substrate, where the particles condense back to solid state. The vacuum deposition process produces highly conformal coatings, which gives rise to highly efficient devices. Many organic light emitting materials oxidize and corrode when exposed to oxygen and water vapor in the environment, which is why these devices need to be encapsulated. This deposition process takes place in a vacuum and the entire structure, including the encapsulation layer, can be produced in a clean, dry environment, which is ideal for producing high efficient device with a long lifetime. Additionally, organic layers can be easily stacked via vacuum deposition to fabricate a multilayer device structure without any damage to the underlying organic layers. However, this deposition technique has several drawbacks including inefficient use of material, poor scalability, high equipment cost, high vacuum pressure, slow rate of deposition, difficult application on 3D structures, and complicated patterning processes. In order to deposit even coating layers on a fiber, the fiber must be constantly turned during the deposition, which increases the complexity of the evaporation chamber set up and constrains the length of fiber produced to the size of the inside of the evaporation chamber.

Dip-coating is a coating procedure where a fiber is inserted into a bath of solution and drawn out of the bath at a set speed and angle. This method is capable of continuously coating fibers as a roll-to-roll process, which makes it attractive for manufacturing. However, displays produced by the dip-coating method often suffer from reduced efficiency when compared to conventional planar devices due to non-uniformity in the dip-coated layers. This is a common problem with the dip-coating process as ambient conditions play a role in liquid properties and must be tightly controlled to avoid variances in the coatings.

Extrusion coating is a process where a substrate is drawn through a coating applicator which consists of a reservoir of liquid or molten polymer and a die that controls the thickness and concentration deposition of the layer. In this case, a fiber is drawn through a cylindrical die after being immersed in bath of coating material. This process is sometimes referred to as obstructed dip coating because the substrate is being drawn through a fluid bath. However, unlike dip coating, which relies only on gravity and the properties of the substrate and coating material, the deposition of the coating material can be easily controlled by the die and is therefore referred to here as extrusion coating.

Figure 6:
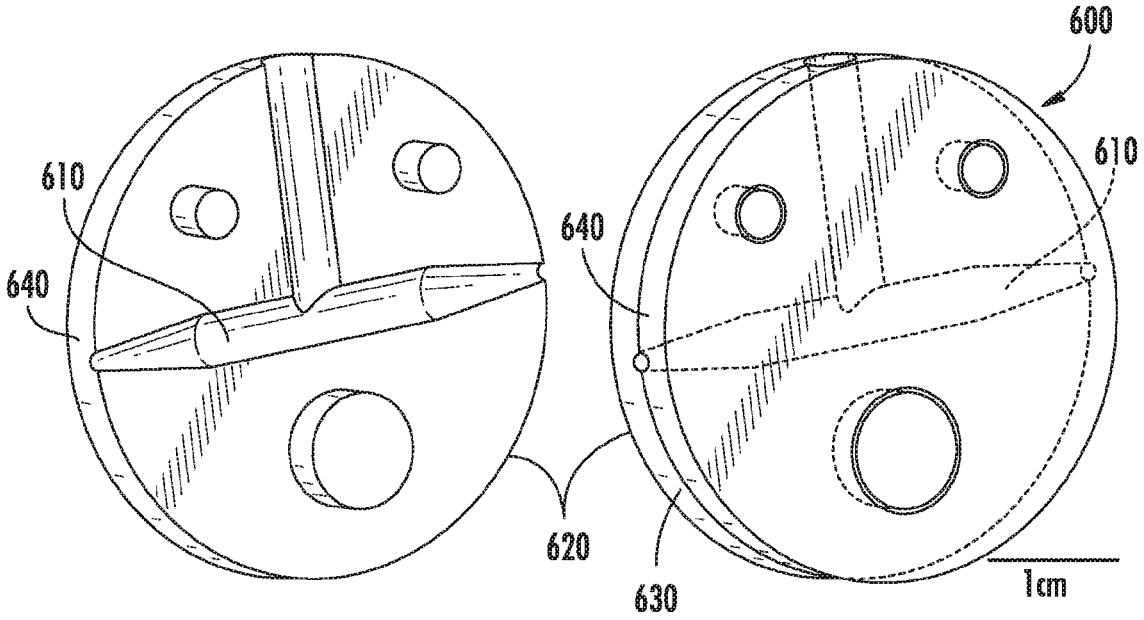
FIG. 6 shows the electroluminescent thread incorporated into the knitted matrix using the pixel structure.

Electroluminescent fibers may be fabricated via extrusion coating by depositing an electroluminescent device structure onto a supporting conductive fiber substrate using a two disk 3D printed extrusion device 600, shown in FIG. 6, which can separate sides 620 and 630 to align the fiber inside the extrusion chamber 610 before it is closed and the fiber is pulled through. The two-piece disk design allows for simple enclosure of the fiber and a syringe is used to inject fluid into the extrusion chamber 610. The fiber is then drawn through the fluid bath and extruded from the opening 640 at set size. The thickness of each layer is dependent on the extrusion tip size, which is calculated based on the size of the underlying fiber and desired layer thickness. Ideally, the fiber should be centered and kept taught as it is drawn through the cylindrical die 600 to allow for uniform layer thickness around the device. The cylindrical die opening 640 can be easily adjusted to accommodate a range of fiber or thread substrate diameters and desired layer thicknesses.

While the invention has been described with reference to the embodiments above, a person of ordinary skill in the art would understand that various changes or modifications may be made thereto without departing from the scope of the claims.

The invention claimed is:

1. A display comprising multiple electroluminescent threads knitted together to form a fabric matrix, forming one or more discrete pixels, wherein a luminosity of each pixel is individually controlled, wherein each pixel is a single stitch in the fabric matrix, wherein each stitch comprises a loop of electroluminescent thread.

2. The display as in claim 1, wherein each pixel comprises an electroluminescent thread that is in contact with a conductive thread.

3. The display as in claim 2, wherein the electroluminescent thread comprises:

a conductive fiber core;

a dielectric layer disposed on the conductive fiber core;

an electroluminescent layer disposed on an outer surface of the dielectric layer; and a protective layer on an exterior of the electroluminescent layer.

4. The display as in claim 2, wherein the fabric matrix comprises a knitted structure.

5. The display as in claim 1, wherein each pixel is electrically insulated from adjacent pixels.

6. The display of claim 5, wherein the insulation from adjacent pixels is accomplished using a stitch of non-conducting thread that also forms the fabric matrix.

7. The display as in claim 1, wherein each pixel is electrically insulated from adjacent pixels by a dielectric coating on the threads.

8. The display of claim 4, wherein the knitted fabric structure possesses a biaxial knitted structure.

9. The display of claim 8, wherein the conductive threads and the electroluminescent threads are inlayed perpendicularly to each other within the knitted fabric structure.

10. The display of claim 1, wherein each pixel is a segment of electroluminescent structure deposited on a conductive fiber.

11. A display comprising pixels, wherein the display comprises a knitted fabric matrix of pixels, wherein each pixel is a single stitch in the fabric matrix, wherein an electroluminescent structure of each pixel comprises:

a conductive fiber core;

a dielectric layer disposed on an outer surface of the conductive core;

an electroluminescent layer comprising electroluminescent threads knitted together to form the knitted fabric matrix disposed on an outer surface of the dielectric layer, wherein each stitch comprises a loop of electroluminescent thread;

a protective isolation coating on the electroluminescent coating; and a translucent conductive coating disposed upon the protective isolation.

12. The display of claim 11, where power is applied to the translucent conductive coating to turn each pixel on separately.

13. The display of claim 12, wherein the electroluminescent threads emit multiple colors.

14. The display of claim 13, wherein portions of the electroluminescent threads are fabricated to emit different colors of light in an alternating pattern.

15. The display of claim 11, wherein the electroluminescent layer comprises multiple individual single-color electroluminescent threads twisted together, wherein each strand produces a different color of light.

16. The display of claim 11, wherein each pixel is individually controlled by means of a microcontroller programmed to apply power to each electroluminescent thread.

17. The display of claim 11, wherein the electroluminescent thread emits light through one or more organic light-emitting diodes, light-emitting electrochemical cells, and inorganic electroluminescent devices.

18. The display of claim 11, wherein electroluminescent material is deposited on the electroluminescent threads through one or more means selected from a list consisting of: vacuum thermal evaporation, dip-coating, and extrusion coating.

19. The display of claim 18, wherein the electroluminescent material is deposited on the electroluminescent threads using extrusion coating.

* * * * *